United States Patent [19]

Freedman et al.

[11] 4,362,917

[45] Dec. 7, 1982

[54] FERRITE HEATING APPARATUS

[75] Inventors: George Freedman, Wayland; Robert F. Bowen, Burlington, both of Mass.

[73] Assignee: Raytheon Company, Lexington, Mass.

[21] Appl. No.: 220,531

[22] Filed: Dec. 29, 1980

[51] Int. Cl.[3] ..... H05B 6/80

[52] U.S. Cl. ..... 219/10.55 E; 219/10.55 F; 219/10.55 M; 426/243; 99/451

[58] Field of Search ..... 219/10.55 E, 10.55 M, 219/10.55 F, 10.55 R; 436/241, 243, 107; 99/451, DIG. 14

[56] References Cited

U.S. PATENT DOCUMENTS

| | | | |
|---|---|---|---|
| 2,830,162 | 4/1958 | Copson et al. | 219/10.55 E X |
| 3,591,751 | 7/1971 | Goltsos | 219/10.55 |
| 3,701,872 | 10/1972 | Levinson | 219/10.55 |
| 3,731,037 | 5/1973 | Levinson | 219/10.55 |
| 3,783,220 | 1/1974 | Tanizaki | 219/10.55 |
| 3,853,612 | 12/1974 | Spanoudis | 219/10.55 E X |
| 3,941,967 | 3/1976 | Sumi et al. | 219/10.55 E |
| 3,941,968 | 3/1976 | MacMaster | 219/10.55 E |
| 3,965,323 | 6/1976 | Forker, Jr., et al. | 219/10.55 E |
| 4,027,132 | 5/1977 | Levinson | 219/10.55 F |
| 4,190,757 | 2/1980 | Turpin et al. | 219/10.55 E |
| 4,210,124 | 7/1980 | Husslein et al. | 219/10.55 E X |
| 4,266,108 | 5/1981 | Anderson et al. | 219/10.55 E |

*Primary Examiner*—Roy N. Envall, Jr.
*Assistant Examiner*—Philip H. Leung
*Attorney, Agent, or Firm*—William R. Clark; Milton D. Bartlett; Joseph D. Pannone

[57] ABSTRACT

A microwave heating appliance having a metallic member supporting a body comprising ferrite bonded to an outer surface of the metallic member with a grooved inner surface of the metallic member contacting a food body to be heated by thermal energy generated from microwave energy absorbed by the ferrite body and transferred through the metallic member to the food body. An additional metallic member forms a container for the food body, and adjacent peripheral areas of the two metallic members provide substantial microwave sealing between the two metallic members thereby substantially shielding the food body from the microwave energy when the appliance is placed in a microwave oven. Upper and lower surfaces of the interior of the appliance contain grooves to form corrugated surfaces which contact the food body and which permit juices produced by heating the food body to flow away from regions of contact between the corrugated surfaces and the food body.

5 Claims, 9 Drawing Figures

FIG. 3
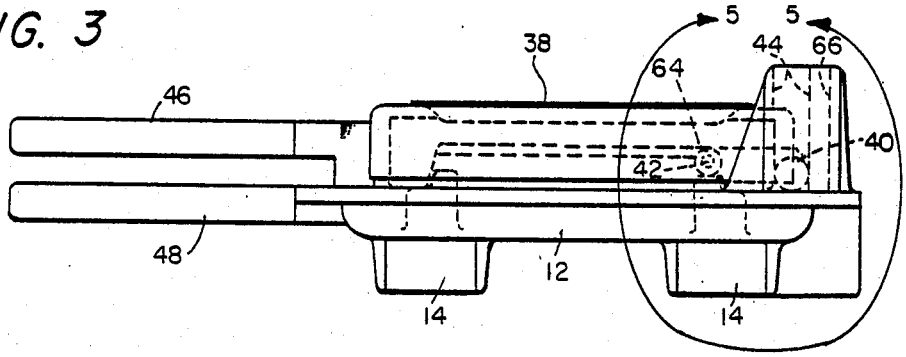
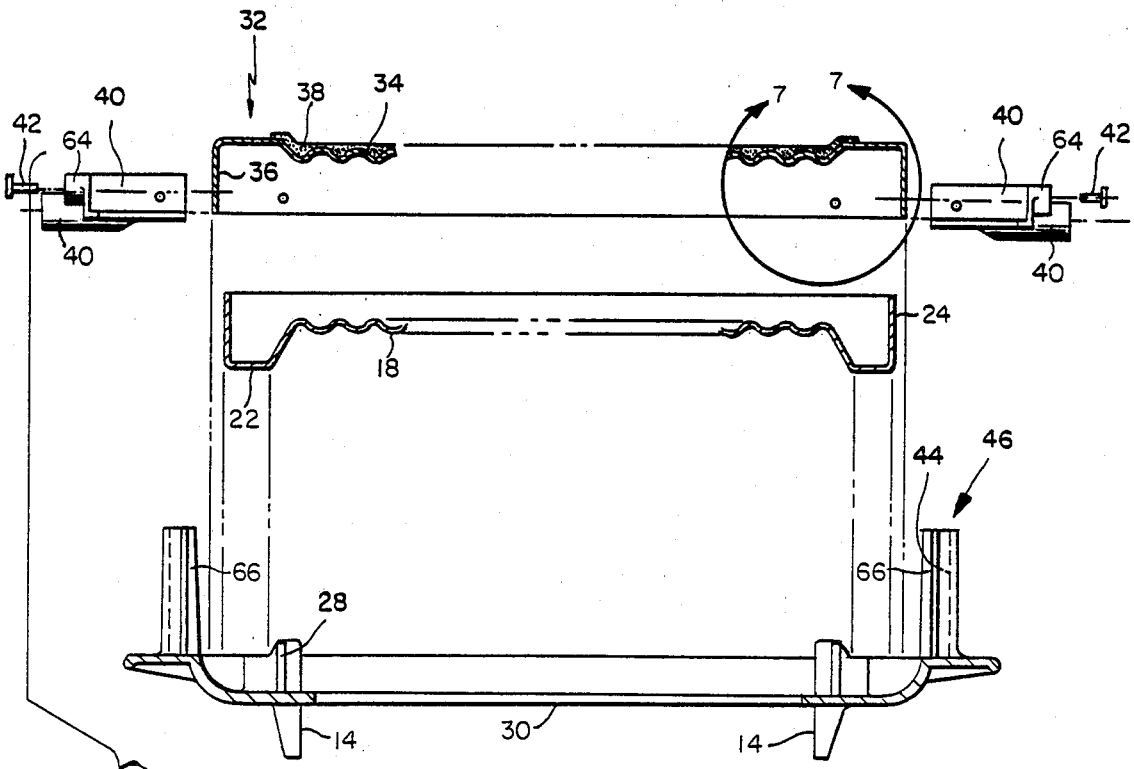
FIG. 4

FERRITE HEATING APPARATUS

CROSS-REFERENCE TO RELATED APPLICATIONS

The disclosure of U.S. application Ser. No. 211,975, filed Dec. 1, 1980 by Wesley W. Teich and Kenneth W. Dudley is incorporated herein by reference and made a part of this disclosure.

BACKGROUND OF THE INVENTION

Attempts have been made to heat food bodies by causing microwave energy to be absorbed by an intermediate body such as a block of ferrite which, in turn, transferred heat to the food body. However, such attempts have not been economically practical since the intermediate materials chosen, such as ferrites, have generally been large and bulky, for example, on the order of a quarter wavelength thick or thicker, and generally the ferrites available have been sintered material which cracked due to the differential temperature encountered in the ferrite.

In addition, when microwave energy is absorbed by the food body itself, the interior portion of the food body becomes overcooked compared with the surface conditions. This is particularly true for food bodies such as steaks and hamburgers where a browned surface food products preferably has a gradation of cooking extending to rare in the center.

Also, heat loss is encountered in cooking foods having juices such as meat fats, by reason of the juice which drains from the meat continuing to absorb microwave energy. This results in a reduction in the cooking rate for a given level of microwave power and a corresponding increase in cooking time as well as changes in the surface texture of the cooked food product.

SUMMARY OF THE INVENTION

In accordance with this invention, there is provided a microwave appliance in which a metal member has a body of ferrite material bonded to an upper surface of said member while a lower surface of said member has a nonplanar surface contacting a food body. The food body is preferably heated predominantly by thermal energy generated in the ferrite material when the appliance is subjected to microwave energy in a microwave oven. More specifically, when the appliance is in a microwave oven, the ferrite material of said ferrite body is preferably positioned substantially entirely within an eighth of a wavelength of the conductive surface of the metal member so that the ferrite material will react with the high magnetic fields produced near said conductive surface due to reflection of the microwaves from the metal member. The dielectric component of the ferrite and/or bonding medium which would react to the electric field component of the microwave energy is substantially shielded by being close to said conductive surface. The appliance thus will absorb microwave energy through the ferrite material until the temperature of the Curie point region of the ferrite material is reached. The amount of microwave energy absorbed by the dielectric component of the ferrite body normally increases with temperature, but will generate substantially less thermal energy than that lost from the microwave appliance by radiation, convection and/or conduction at normal cooking temperatures. Preferably, a ferrite material is chosen having a Curie point region which is between 500° and 800° F., but below the degradation temperature of thermal insulating materials adjacent the ferrite body.

In accordance with this invention, the microwave appliance is made of two metallic members having substantial peripheral areas which oppose each other when a food body is inserted in the container, and the metal cover is closed over the metal food container. Due to the substantial surface area between the surface area and the peripheral opposing regions, the microwave energy is substantially inhibited from passing through the space between the two metallic members of the appliance so that the food body is cooked predominantly by the transfer of thermal energy from the ferrite material through one or both of the metallic members to the food body. In accordance with this invention, the interior surface regions of the microwave appliance opposite to the ferrite material are formed with substantially nonplanar contours, such as grooves, forming corrugated surfaces so that juices produced by the food body during cooking can flow away from the regions of contact of the food body with the metal member supporting the ferrite material. As a result, substantially all the thermal energy goes into heating the food body while substantially none is used to heat the juices.

BRIEF DESCRIPTION OF THE DRAWINGS

Other and further objects and advantages of the invention will be apparent as the description thereof progresses, reference being had to the accompanying drawings wherein:

FIG. 3 illustrates a side elevation view of the microwave appliance illustrated in FIGS. 1 and 2;

FIG. 4 illustrates an exploded sectional view of portions of the microwave appliance of FIGS. 1–3 taken along line 4—4 of FIG. 1;

DESCRIPTION OF THE PREFERRED EMBODIMENT

Figure 1:
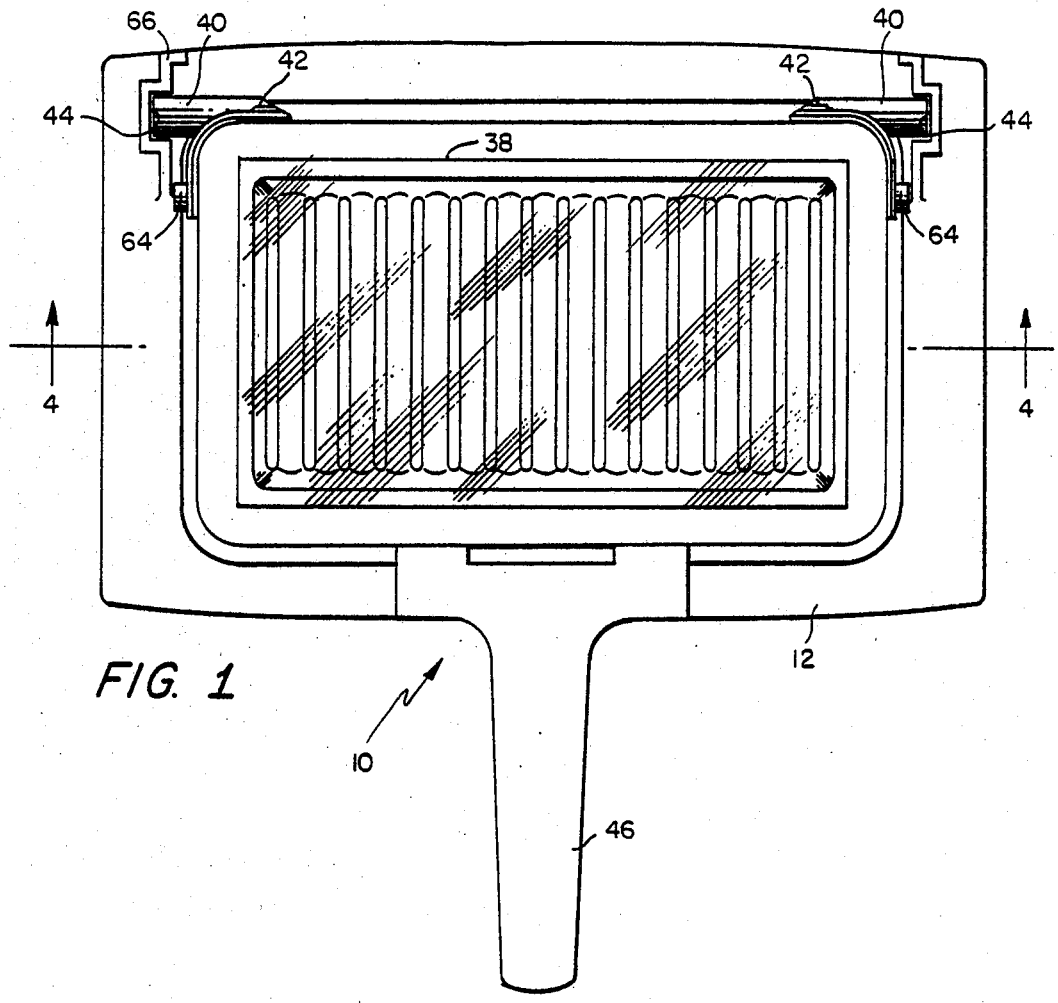
FIG. 1 illustrates a top plan view of a microwave appliance embodying the invention.
Figure 2:
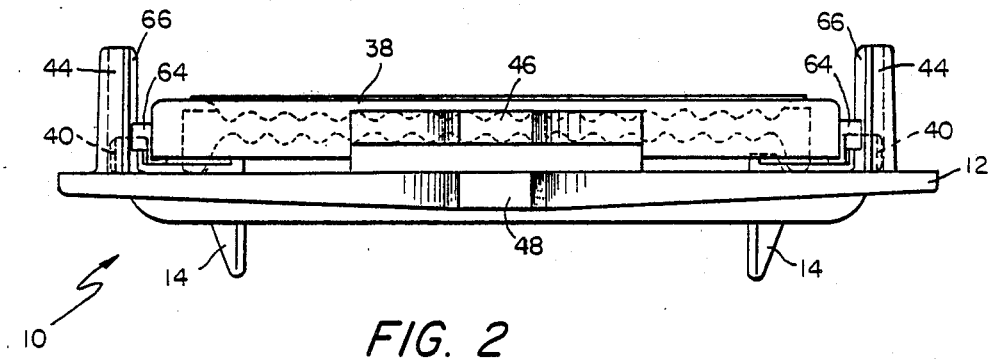
FIG. 2 illustrates a front elevation view of the microwave appliance illustrated in FIG. 1.
Figure 8:
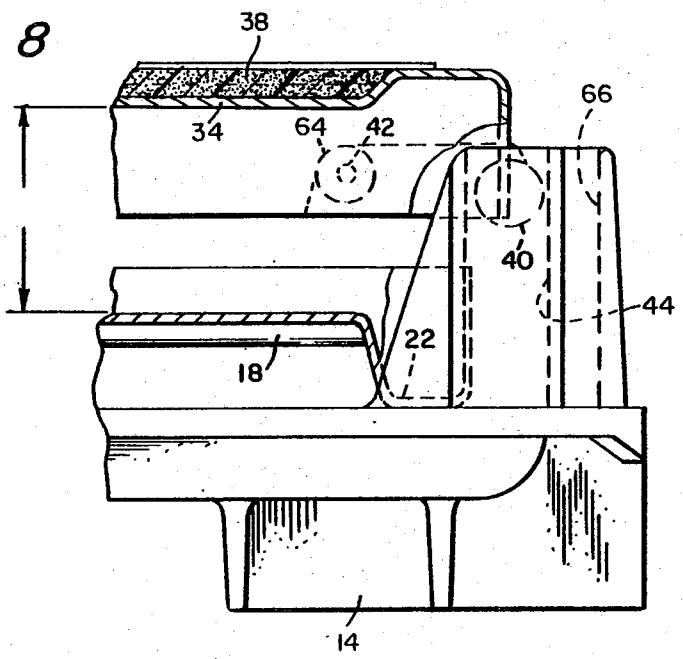
FIG. 8 illustrates the same detail as FIG. 5 but with the cover elevated to accomodate a large food body and with the dish and cover in cross-section.
Figure 7:
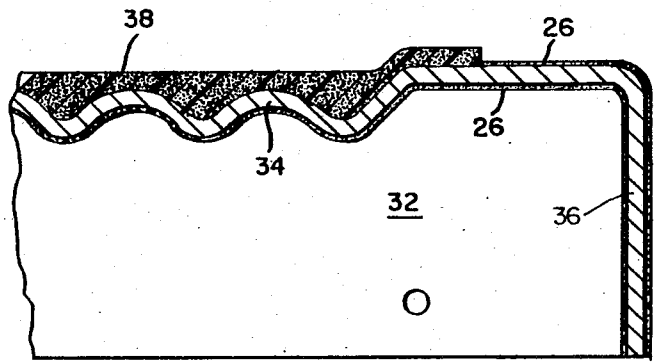
FIG. 7 illustrates a detail of the cover of FIG. 6 taken along line 7—7 of FIG. 6.
Figure 5:
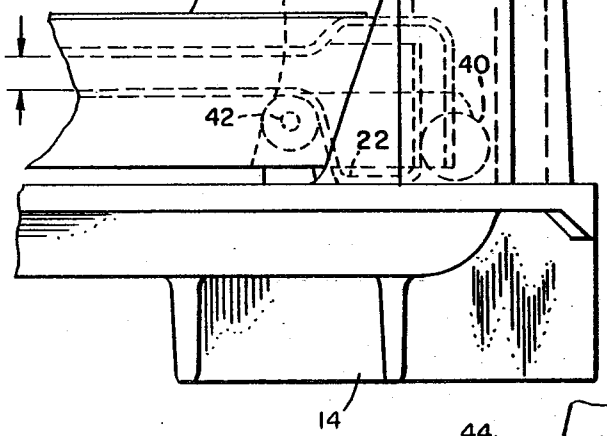
FIG. 5 illustrates a detailed view of a portion of the hinge used in the microwave appliance of FIGS. 1–3 taken along line 5—5 of FIG. 4 with the microwave appliance cover closed.
Figure 6:
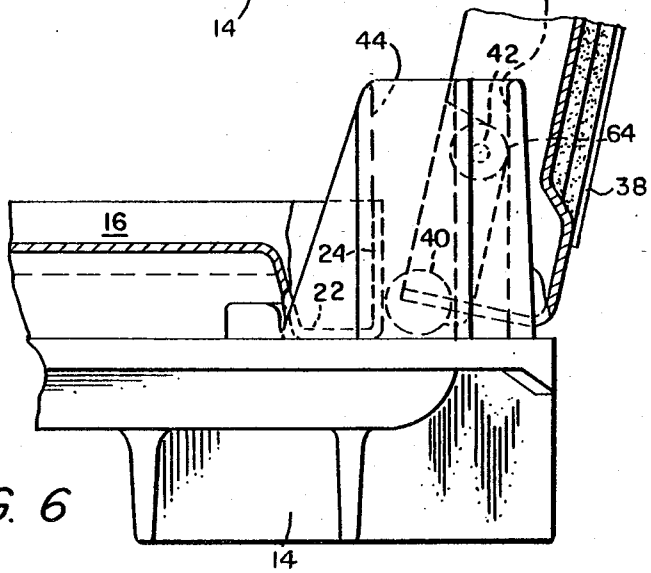
FIG. 6 illustrates the same detail as FIG. 5 but with the microwave appliance cover open and with the cover and dish shown in cross-section.

Referring now to FIGS. 1–8, there is shown an appliance 10 for cooking a food body such as a beef steak in a microwave oven. The appliance 10 comprises a base portion 12 of thermally insulating material such as high temperature plastic formed, for example, by molding in accordance with well-known practice. Four legs 14 extend downwardly and are molded integrally with base portion 12. Base portion 12 supports a food container dish 16 made, for example, of metal and having rib-like members 18 forming a corregated region in its lower surface on which a food body 20 may rest. Preferably, dish 16 is made of thin metal such as aluminum and the rib-like members in the bottom serve the added function of stiffening the dish structure. Dish 16 also has a depressed trough region 22 formed around the periphery of the ribbed bottom of the dish with the bottom of the trough being substantially below the bottoms of the ribbed grooves so that juices and fats which drain from the food body 20 during heating can drain along the grooves between the ribs 18 and into the trough 22. A perimeter wall 24 of the dish extends around the periphery of the dish from the bottom of the trough region to a point above the ribs 18 so that juices and fats from the food body will be drained away from the food body to the trough region 22 where they will no longer be heated during the cooking process thereby eliminating their absorption of additional heat from the food body.

The surfaces of dish 16 are preferably coated with a non-stick layer 26 of high temperature plastic such as Teflon in accordance with well-known practice.

In order to minimize the transfer of heat from dish 16 to the base 12, the dish 16 contacts the base 12 only in the regions of four small bosses 28 spaced around the periphery of the dish and formed integrally with the molded base 12. Bosses 28 contact the dish 16 as shown at the bottoms of the trough 22 and at the sloping interior peripheral wall of the trough 22 so that such points of contact are separated from the ribbed members 18 supporting the food body by substantial distances of the thin metal dish 16. These substantial distances act as thermal chokes which reduce the amount of thermal energy flowing from the dish into the base portion 12, thereby reducing cooling of the food body and preventing the base 12 from overheating. In addition, the region of the base portion below the ribbed dish members 18 has a substantial aperture 30 so that air may circulate past the regions of the base 12 closest to the dish to ensure that no portion of the plastic base portion 12 exceeds a temperature of, for example, 200° C. above which the base 12, which may be rigid plastic such as a polycarbonate, might become weakened or in time deteriorate.

A cover member 32, formed of thin metal such as aluminum, has ribs 34 forming a corregated region therein above the ribbed members 18 in dish 16. Ribs 34 preferably engage the upper surface of the food body 20 during cooking.

Cover 32 has a peripheral metal wall 36 extending substantially vertically downwardly from its upper surface outside, and spaced from, the metal wall 24 of dish 16. Wall 36 forms an overlapping region with wall 24 which acts as a microwave seal so that steam and other vapors may exit from the dish through the space between the walls 36 and 24 while microwave energy is substantially prevented from entering the dish.

A flexible plastic bonded ferrite microwave absorbing body 38 is supported on top of cover 32 contacting the surface of the corregated region of ribs 34. Region 38 acts as a heating element by absorbing microwave energy when the appliance 10 is subjected to microwave fields, for example, in a microwave oven and the thermal energy generated thereby is transferred from ferrite region 38 through the ribbed region 34 of cover 32 to cook the food body 20 in contact with the cover 32.

The ferrite region 38 may be, for example, formed of particles of a standard ferrite, such as the ferrite $Q_1$ supplied by Indiana General imbedded in a flexible high temperature plastic so that as the element 38 heats and the aluminum ribbed regions of the cover 32 heat, cracking will not occur of the ferrite region 38 due to stretching of the plastic. Preferably, the ferrite material is chosen so that the center of its Curie point region is between 250° C. and 350° C. so that microwave energy absorption by the ferrite will be substantially reduced before the plastic binder material of heater element 38 reaches a temperature substantially in excess of 300° C. As used throughout the specification and claims, the term "Curie point region" is intended to mean the temperature range in which a ferrite has its value of magnetic permeability reduced from 90% of its room temperature value to 50% of its room temperature value as the ferrite is heated from room temperature through said temperature range. Thus, in a conventional microwave oven supplying a maximum of 800 watts of microwave energy, a surface of ferrite element 38 exposed to the microwave energy of, for example, $4\frac{1}{2}$ inches by 8 inches will not reach a temperature in excess of 500°-550° F. when heated in a microwave oven. This invention takes advantage of the fact that ferrite material responds to the high magnetic fields associated with the reflective surface of the cover 32 to couple the microwave energy into the ferrite 38. This effect is at a maximum in the low impedance region adjacent the highly conductive surface of the cover 32. The flexible plastic binder of the ferrite heating element 38 being very close to the highly conductive surface, couples relatively poorly to the electric field of the microwave energy adjacent the surface of the cover 32 since this electric field is weak adjacent the highly conductive surface. Thus, flexible high temperature plastic whose degradation temperature is above 600° F., such as the commercially available silicone based plastic SILASTIC, can be used to bond the ferrite particles together and to bond to the Teflon coating 26 on cover 32.

For preferred results, this invention teaches that the distance of the exposed surface of the ferrite body 38 is preferably within a distance of $\frac{1}{8}$ of an inch to $\frac{3}{8}$ of an inch from the closest metal surface of the cover 32. Thinner ferrite bodies 38 do not provide enough ferrite material to efficiently absorb all the microwave energy into thermal energy whereas thicker ferrite bodies 38 have portions of the ferrite body sufficiently far from the conductive surfaces of the cover that substantially dielectric heating of the flexible plastic binder in the body 38 occurs.

The cover 32 has two plastic pivots 40 attached to the exterior rear corners thereof, for example, by metal rivots 42 or by any other desired means such as gluing or plastic bonding. Since the pivots 40 are separated from the ferrite heating element 38 by substantial distances of the thin metal of the cover 32, they do not approach the temperature of the ferrite material 38 due to the thermal choking action of the thin metal regions of the cover 32. Plastic pivots 40 pivotally slide in grooves 44 vertically molded into projections formed integrally with and upstanding from the rear corners of base 12. Movement of cover 32 is thus restricted by the action of pivots 40 in grooves 44 to vertical movement and to pivoting motion for opening the cover 32 to expose the food body 20 and the wall 36 of cover 32 is maintained in spaced relationship to the wall 24 of dish 16. Preferably, such spacing between the walls 24 and 36 is substantially less than a quarter wavelength of the 2.45 KMH microwave energy conventionally used in domestic microwave ovens. For example, as shown in the present dish, a spacing of approximately $\frac{3}{8}$ of an inch is formed between the walls. Pivots 40 are also positioned so that when no food body is in the dish, they will support the cover 32 by engaging the bottoms of the grooves 44.

A handle 46 is attached to the front region of the cover wall above a similar handle 48 molded integrally with base 12 and supports the front of cover 32 from the base 12 so that the upper edge of dish wall 24 does not touch the interior of cover 32. Otherwise, deterioration by abrasion of the dish and cover by microwave energy arcing might occur.

Figure 9:
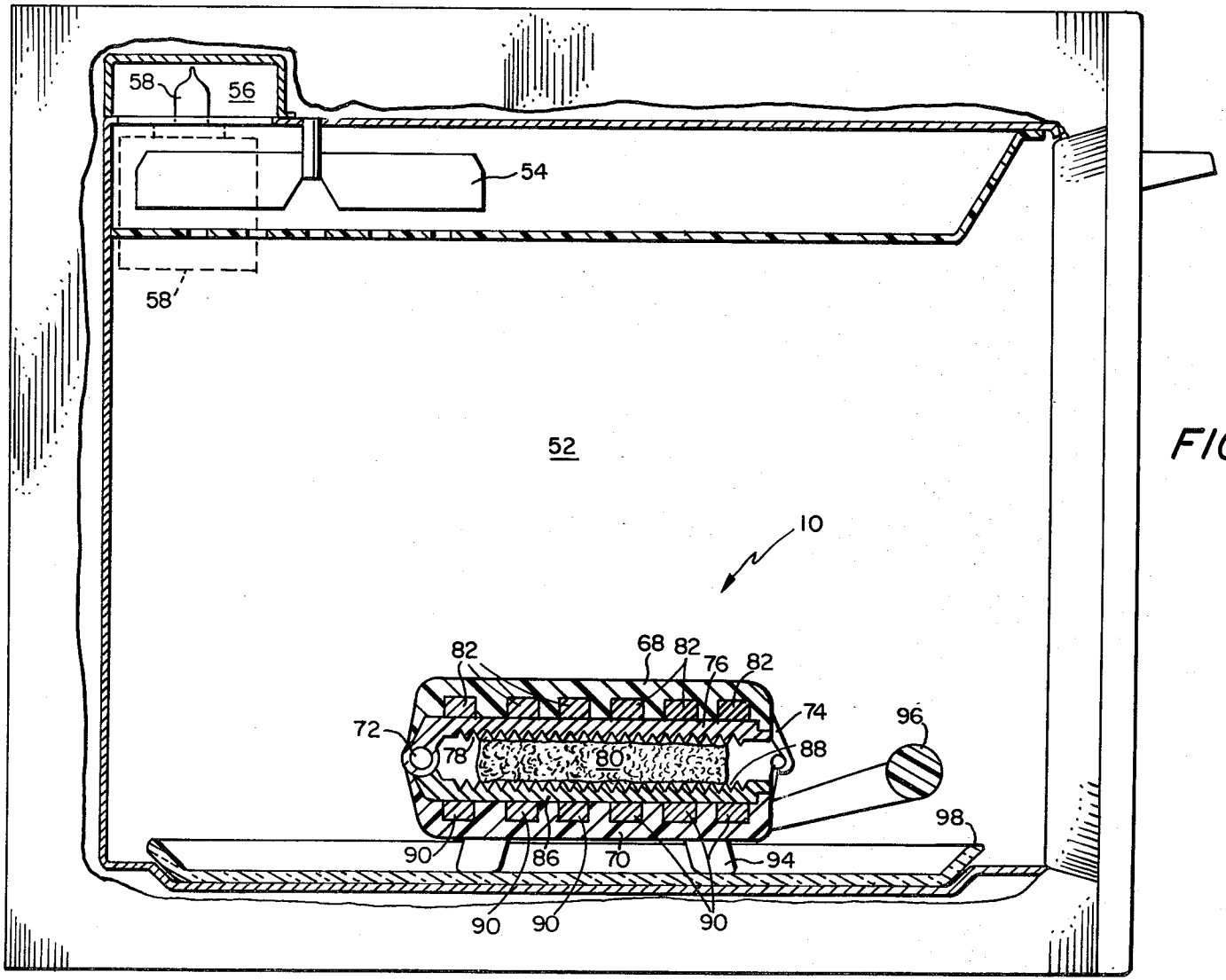
FIG. 9 illustrates the dish of FIGS. 1–3 being used in a microwave oven to heat a food body in accordance with this invention.

Referring now to FIG. 9, there is disclosed an alternate embodiment of the appliance in a microwave oven. A microwave oven 50 may be of any desired type such as the commercially available domestic microwave oven having a heating cavity 52 supplied with microwave energy from a waveguide 56 coupled to magnetron 58. A mode stirrer 54 rotated by air or a motor (not shown) reflects microwave energy in cavity 52 to vary the mode pattern. Microwave oven 50 may have conventional timing controls (not shown) in accordance with well-known practice. A door 60 swings down to provide access to the enclosure 52 so that the microwave appliance 10 may be inserted in the oven and removed therefrom.

Different maximum temperatures of the ferrite bodies may be achieved by using different percentages of ferrite material in the ferrite body. However, a preferred percentage of ferrite is in the range between 75 and 80% by weight with the remainder comprising a high temperature binder which binds the particles together and is, in turn, bonded to the metal member or members.

The microwave appliance 10 is an alternate embodiment of the microwave appliance disclosed in FIGS. 1–8. Microwave appliance 10 comprises upper and lower halves 68 and 70 of high temperature plastic which are hinged together by a hinge 72 and held together when closed by a plastic hasp 74. An upper plate 76 of aluminum has a lower surface with grooves 78 to form a nonplanar surface contacting a food body 80, such as a body of chopped steak. A plurality of bodies of ferrite 82 are bonded to the upper surface of metallic member 76, and intervening spaces between the ferrite members 82 are filled with plastic regions which are part of plastic cover 68. Ferrite members 82 are bonded to the inner surface of the plastic cover 68. A metallic plate 86 similar to metallic plate 76 is positioned below food body 80 with grooves 88 therein contacting the lower surface of food body 80. Ferrite members 90 are bonded to the lower surface of plate 86. Regions of lower plastic member 70 extend between ferrite members 90 with both ferrite members 90 and plastic members 70 being bonded to the lower surface of metal member 86.

Plastic feet 94 extend from the bottom of lower plastic member 70 and a plastic handle 96 extends from a wall of the member 70 on the opposite side thereof from hinge 72. Feet 94 and handle 96 are preferably molded integrally with lower member 70. Hinge 72 is preferably formed as extensions of metal members 76 and 86. The peripheral regions of metallic members 86 and 76 substantially inhibit microwave energy from entering the container so that little or no substantial heating of food body 80 occurs directly by microwave energy. Rather, the thermal energy for cooking food body 80 is derived predominantly from microwave energy being absorbed by the ferrite members 82 and 90. The embodiment of microwave appliance 10 shown in FIG. 9 preferably has the upper surface area containing ferrite members 82 sized to approximately half the area of that shown in the appliance of FIGS. 1 and 2 or approximately 4 inches by 4 inches so that microwave energy may simultaneously supply thermal energy to both the lower and upper surfaces of the food body 80.

As illustrated herein, ferrite bodies 82 and 90 are preferably entirely within an eighth of a wavelength of the microwave energy supplied to cavity 52 so that their primary heating effect is due to the microwave frequency magnetic fields adjacent the surfaces of the metallic support members 76 and 86.

DESCRIPTION OF THE PREFERRED MODE OF OPERATION OF THE INVENTION

In operation, a food body such as a beef steak 20 or chopped steak 80 is placed on the rib-like members 18 in the dish 16, and the dish 16 is in the appliance and the cover is closed.

The microwave appliance 10 is then placed in the oven 50 and the door 60 is closed. An appropriate time such as 5 to 10 minutes is set on the microwave oven controls with the oven power setting preferably at full power. The oven start button is then actuated and microwave energy is supplied from the magnetron 58 through the waveguide 56 and through the aperture between the waveguide and oven wall to cavity 52.

Microwave energy in enclosure 52 impinges on ferrite bodies 82 and 90 where it is converted to thermal energy which is transferred by conduction through the metal members 76 and 86 to food body 80. Thermal energy is then transferred to the food body 80 by conduction and/or radiation to heat and brown the surface of the food body. The browning will appear more predominantly as a series of bars formed by the points of contact of the metal members 76 and 86.

Vapors given off by the food body 20 pass through the spaces between the points of contact of the food body 20 with said metal members 76 and 86 so that they cease to be heated by conduction from said metal members.

When the preset time has elapsed, the door 60 is opened and the appliance 10 pulled out from the oven by the base handle 96.

Thus, it may be seen that a food body may be cooked and/or browned on both sides to any desired degree in accordance with the invention by simply setting the timing of the microwave oven to supply the desired total amount of energy to the appliance 10. The appliance may be used in general with any microwave oven without overheating and with good results.

This completes the description of the embodiments of the invention illustrated herein. However, many modifications thereof will be apparent to persons skilled in the art without departing from the spirit and scope of the invention. For example, different sizes and thicknesses of food bodies as well as different types of food bodies may be cooked and browned in the microwave appliance. More specifically, sausages, fish, poultry and other similar food products may be cooked with microwave energy being first converted by the ferrite heating element to thermal energy which is then transferred by conduction to the interior of the appliance. Different kinds of ferrite materials may be used for the heating element, and materials other than plastic can be used for the base and handles. Accordingly, it is desired that this invention be not limited to the specific embodiments of the invention illustrated herein except as defined by the appended claims.

What is claimed is:

1. A microwave heating appliance comprising:

a metallic container for holding a food body, said container having a substantially vertical lip, said container reflecting microwave energy incident from underneath;

a microwave transparent base for supporting said container;

a corrugated metallic cover pivotally movable with respect to said base, said cover being supported by said food body, said cover further having substantially vertical sides spaced from and substantially parallel to said lip of said container for forming a microwave choke to shield the interior of said container from microwave energy; and a microwave energy absorber comprising ferrite material bonded to the upper surface of said cover for absorbing microwave energy at a substantial rate at temperatures below the Curie point region of said ferrite material while absorbing microwave energy at a substantially lower rate at temperatures above said Curie point region.

2. The microwave heating appliance of claim 1 wherein said Curie point region is above 500° F.

3. The microwave heating appliance in accordance with claim 1 wherein said base has a plastic handle molded integrally therewith.

4. The method of heating a food body using microwave energy, comprising the steps of:

shielding said food body in an interior region defined by first and second corrugated pan-shaped metallic members having peripheral portions that are substantially parallel to each other, said first member being positioned above said second member, said second member being supported by a microwave transparent base, said first member being pivotally movable with respect to said base;

exposing a ferrite microwave energy absorber adhered to the upper surface of said first member to microwave energy to generate heat therein; and conducting said heat through said first member to heat said food body positioned in said region.

5. A utensil for heating food in a microwave oven, comprising:

a metal container having substantially vertical sides;

a metal cover having a corrugated top;

said cover further having substantially vertical sides spaced from and substantially parallel to said sides of said container for forming a microwave choke to shield the interior of said container from microwave energy;

a microwave absorbing layer comprising ferrite bonded to the upper surface of said top;

a microwave transparent base supporting said container in an elevated position, said base having legs to allow air to flow underneath said container, said base having two grooved vertical columns; and said cover having two microwave transparent posts extending horizontally from opposite sides therefrom, said posts respectively engaging said grooves for providing horizontal alignment between said container and said cover.

* * * * *